US010487481B2

(12) United States Patent
Kiefer et al.

(10) Patent No.: US 10,487,481 B2
(45) Date of Patent: Nov. 26, 2019

(54) SANITARY OUTFLOW PART AND CORRESPONDING USE

(71) Applicant: Neoperl GmbH, Mullheim (DE)

(72) Inventors: Thomas Kiefer, Neuenburg (DE); Michael Steinbrunner, Neuenburg (DE)

(73) Assignee: NEOPERL GMBH, Mullheim (DE)

( * ) Notice: Subject to any disclaimer, the term of this patent is extended or adjusted under 35 U.S.C. 154(b) by 28 days.

(21) Appl. No.: 15/869,798

(22) Filed: Jan. 12, 2018

(65) Prior Publication Data

US 2018/0202134 A1 Jul. 19, 2018

(30) Foreign Application Priority Data

Jan. 19, 2017 (DE) ..... 20 2017 100 277 U

(51) Int. Cl.

| | |
|---|---|
| ***E03C 1/04*** | (2006.01) |
| ***E03C 1/086*** | (2006.01) |
| ***E03C 1/084*** | (2006.01) |
| ***E03B 9/20*** | (2006.01) |

(52) U.S. Cl.

CPC ..... *E03C 1/0405* (2013.01); *E03B 9/20* (2013.01); *E03C 1/084* (2013.01); *E03C 1/086* (2013.01)

(58) Field of Classification Search

CPC ..... E03C 1/0404; E03C 1/0405; E03C 1/084; E03C 1/086; E03B 9/20

USPC ..... 239/12, 24–27, 428.5

See application file for complete search history.

(56) References Cited

U.S. PATENT DOCUMENTS

| | | | | |
|---|---|---|---|---|
| 2,994,481 A | | 8/1961 | Blumberg | |
| 3,030,029 A | * | 4/1962 | Slater, Jr. | E03B 9/20 239/25 |
| 3,062,452 A | * | 11/1962 | Knight | E03C 1/086 239/25 |
| 3,079,088 A | | 2/1963 | Hermann et al. | |
| 3,101,174 A | * | 8/1963 | Loveland | E03C 1/084 239/27 |
| 3,335,957 A | * | 8/1967 | Jacobson | E03B 9/20 100/901 |
| 3,462,080 A | * | 8/1969 | Demaree | E03B 9/20 239/27 |
| 3,512,711 A | * | 5/1970 | Abbott | E03B 9/20 239/25 |
| 3,533,554 A | | 10/1970 | Mongerson | |
| 3,580,503 A | | 5/1971 | Ligon | |
| 4,537,350 A | * | 8/1985 | Apri | E03C 1/16 239/25 |

(Continued)

FOREIGN PATENT DOCUMENTS

| | | |
|---|---|---|
| DE | 1914807 | 2/1970 |
| DE | 202015001886 | 7/2016 |
| WO | 2009091118 | 7/2009 |

*Primary Examiner* — Darren W Gorman

(74) *Attorney, Agent, or Firm* — Volpe and Koenig, P.C.

(57) ABSTRACT

In the case of a sanitary outflow part (1), it is provided that, between an inlet opening (2) and an outlet opening (3), in a flow path (4) which leads through a jet regulator unit (5), a secondary outlet (7) branches off downstream of the jet regulator unit (5). This secondary outlet leads to an additional secondary outlet opening (8) such that water entering via the inlet opening (2) emerges to the secondary outlet opening (8) at least when the outlet opening (3) of the sanitary outflow part (1) is closed off.

20 Claims, 2 Drawing Sheets

(56) References Cited

U.S. PATENT DOCUMENTS

| | | | | |
|---|---|---|---|---|
| 5,195,681 | A * | 3/1993 | Chyen | E03B 9/20 239/25 |
| 5,257,647 | A | 11/1993 | Wilhite | |
| 6,732,956 | B1 * | 5/2004 | Chetrit | A61C 17/02 239/25 |
| 2005/0098650 | A1 * | 5/2005 | Gross | E03B 9/20 239/24 |
| 2011/0233296 | A1 * | 9/2011 | Stude | E03B 9/20 239/25 |
| 2017/0268210 | A1 | 9/2017 | Blum | |

* cited by examiner

SANITARY OUTFLOW PART AND CORRESPONDING USE

INCORPORATION BY REFERENCE

The following documents are incorporated herein by reference as if fully set forth: German Patent Application No. 20 2017 100 277.2, filed Jan. 19, 2017.

BACKGROUND

The invention relates to a sanitary outflow part, having an inlet opening, which is designed for fastening to a fitting, and having an outlet opening, a jet regulator unit with at least one aeration opening being arranged in a flow path between the inlet opening and the outlet opening.

The invention also relates to the use of a sanitary outflow part.

Sanitary outflow parts of the described type are known. The jet regulator unit serves for the admixing of air to a throughflowing water jet, whereby said water jet has more pleasant jet characteristics imparted to it. The use of a jet regulator unit places particular demands on a downstream water outlet because, where possible, it is necessary to prevent the formed water jet from being impaired and disrupted.

SUMMARY

The invention is based on the object of expanding the usage possibilities of a sanitary outflow part.

This object is achieved with a sanitary outflow part having one or more features of the invention. In particular, it is provided according to the invention, in order to achieve the stated object, in the case of a sanitary outflow part of the type described in the introduction that a secondary outlet is formed which is branched off in the flow path between the jet regulator unit and the outlet opening and which is led out in a laterally spaced-apart manner at a separate secondary outlet opening.

Thus, a further usage possibility is created in the case of which the outflowing water can be diverted into the secondary outlet. The water flowing out via the secondary outlet is more easily accessible to a user, and can for example be drunk and/or used for mouth rinsing and/or face washing purposes.

In one refinement of the invention, it may be provided that the secondary outlet opening is formed above the jet regulator unit in a usage position. It is thus possible to prevent a situation in which water emerges from the secondary outlet opening when the outlet is open.

In one refinement of the invention, it may be provided that the secondary outlet forms a duct which runs at an angle with respect to the flow path and counter to a flow direction of the flow path and at the open end of which the secondary outlet opening is formed. It can thus be achieved that the water emerges from the secondary outlet at an angle directed obliquely upward. The emerging water jet is then particularly easily accessible.

In one refinement of the invention, it may be provided that the flow path is formed without a valve at least downstream of the jet regulator unit. Thus, the aerated water jet is influenced, disrupted or altered as little as possible on the path to the point at which the water emerges at the outlet.

In one refinement of the invention, it may be provided that an aeration chamber is formed between the inlet opening and the outlet opening, which aeration chamber extends outside the flow path, the at least one aeration opening being connected to the aeration chamber. A distribution of air to the aeration openings is thus possible. This is particularly expedient if a plurality or multiplicity of aeration openings, for example two, three, four, eight or more than eight aeration openings, is or are formed. During use, the jet regulator unit can thus be fed with air from the aeration chamber. The aeration chamber is preferably of ring-shaped form in order to permit aeration from all sides along a full circumference.

In one refinement of the invention, it may be provided that the secondary outlet is branched off from the aeration chamber. It can thus be achieved that an air flow that is drawn in from the aeration openings during use flows via the secondary outlet. This permits drying of the secondary outlet when the latter is not in use. Thus, the risk of settlement of pathogens in the secondary outlet can be reduced.

In one refinement of the invention, it may be provided that an internal diameter of the outlet opening is coordinated with a jet diameter predefined by the jet regulator unit. It can thus be achieved that the formed water jet can emerge in an undisrupted manner. Since in particular the outer layers of the water jet determine a visual appearance outside the water outlet, undesired impairments can thus be avoided. It is particularly expedient here if the internal diameter is slightly greater than the jet diameter, for example greater at most to such an extent that a water jet emerging from the jet regulator unit does not make contact with the outlet opening, but rather emerges without making contact despite the inevitable jet widening. This allows even the widened water jet to emerge from the outlet in an entirely undisrupted manner.

In one refinement of the invention, it may be provided that the aeration chamber is separated from the flow path by a closed wall in which the at least one aeration opening is formed. Thus, an undesired ingress of water, for example spray water, into the secondary outlet can be prevented. The secondary outlet can thus be kept dry when not in intended use. Here, it may be provided that, when the outlet is closed off, a space enclosed by the wall can be flooded such that inflowing water emerges through the at least one aeration opening into the secondary outlet.

In one refinement of the invention, it may be provided that the jet regulator unit has a diffuser. Thus, aeration of the water jet can be achieved easily with means that are known per se. Alternatively or in addition, it may be provided that the jet regulator unit has a flow rate regulator. Thus, a throughflow rate can be configured in a pressure-independent manner, at least within a pressure working range. The jet pattern can thus be better controlled, and legal specifications can be satisfied, even for the downstream secondary outlet.

In one refinement of the invention, it may be provided that at least one diffuser exit opening is arranged radially within the wall. In a known manner, the admixing of air occurs in the region of the diffuser exit opening. Here, the flow is particularly non-uniform, such that the risk of spray water is particularly high. The arrangement within the wall can assist in preventing an ingress of spray water into the secondary outlet. Thus, the secondary outlet can be kept dry when not in intended use.

In one refinement of the invention, it may be provided that, on the inlet opening, there is formed a thread which can be screwed together with a counterpart thread of a fitting. Thus, the outflow part can be fastened fixedly to the fitting. A force caused by a flow resistance generated by the jet regulator unit can thus be absorbed by the screw connection.

It can therefore be achieved that the sanitary outflow part remains on the fitting even in the presence of a high operating pressure.

In one refinement of the invention, it may be provided that a sealing ring is placed into the inlet opening. Thus, an undesired emergence of water at the inlet opening can be prevented. This is particularly advantageous in the presence of high operating pressures or throughflow rates, because the jet regulator unit generally forms a considerable flow resistance.

In one refinement of the invention, it may be provided that the jet regulator unit is insertable and/or removable as a cartridge via the inlet opening. Thus, the jet regulator unit can be easily exchanged, for example in the event of fouling or lime-scale deposits. It is also possible for jet regulator units available in standardized form to be used, if a receiving interior space is dimensioned correspondingly.

In one refinement of the invention, it may be provided that a housing which forms the inlet opening, the outlet opening and/or the secondary outlet opening is manufactured from a dimensionally stable material. It is thus possible to provide a stable outflow part. The jet regulator unit that is used can be protected against mechanical damage from the outside. The housing is preferably manufactured from plastic, for example POM (polyoxymethylene). This makes it possible to realize a stable and visually and/or haptically appealing design, in particular in a manner coordinated with the fitting. The housing may also be manufactured from metal.

In one refinement of the invention, it may be provided that the jet regulator unit is inserted, for example through the inlet opening, into the outlet opening. It is thus possible to achieve that the formed water jet, in the form that it emerges from the jet regulator unit, is conducted directly into the outlet opening. It is preferably provided here that the jet regulator unit has, at least in one end region, an external diameter which is coordinated with an internal diameter of the outlet opening. The jet regulator unit is thus held in a predetermined position in a simple manner. It is particularly expedient for the external diameter to be greater than the internal diameter to such an extent that the jet regulator unit is held by the outlet opening.

In one refinement of the invention, it may be provided that the outlet opening can be closed off using a finger. A user can thus easily close off the outlet, without additional valves, in order to utilize the secondary outlet.

In one refinement of the invention, it may be provided that the aeration chamber is closed or sealed off against the outside downstream of the secondary outlet, preferably by tight contact between the armature housing and the cartridge. This forces air sucked in for aeration to dry up the secondary outlet in normal operation mode.

A preferred application of the invention provides the use of a sanitary outflow part according to the invention, in particular as described above and/or according to one of the claims directed to a sanitary outflow part, to use the sanitary outflow part on a sanitary fitting, in particular of a wash basin and/or drinking basin, the sanitary outflow part being mounted, in particular mounted by screw fastening, on a fitting outflow.

BRIEF DESCRIPTION OF THE DRAWINGS

The invention will now be described in more detail on the basis of an exemplary embodiment, but is not restricted to this exemplary embodiment. Further exemplary embodiments emerge from a combination of the features of individual or several claims with one another and/or with individual or several features of the exemplary embodiment.

In the figures.

DETAILED DESCRIPTION OF THE PREFERRED EMBODIMENTS

Figure 3:
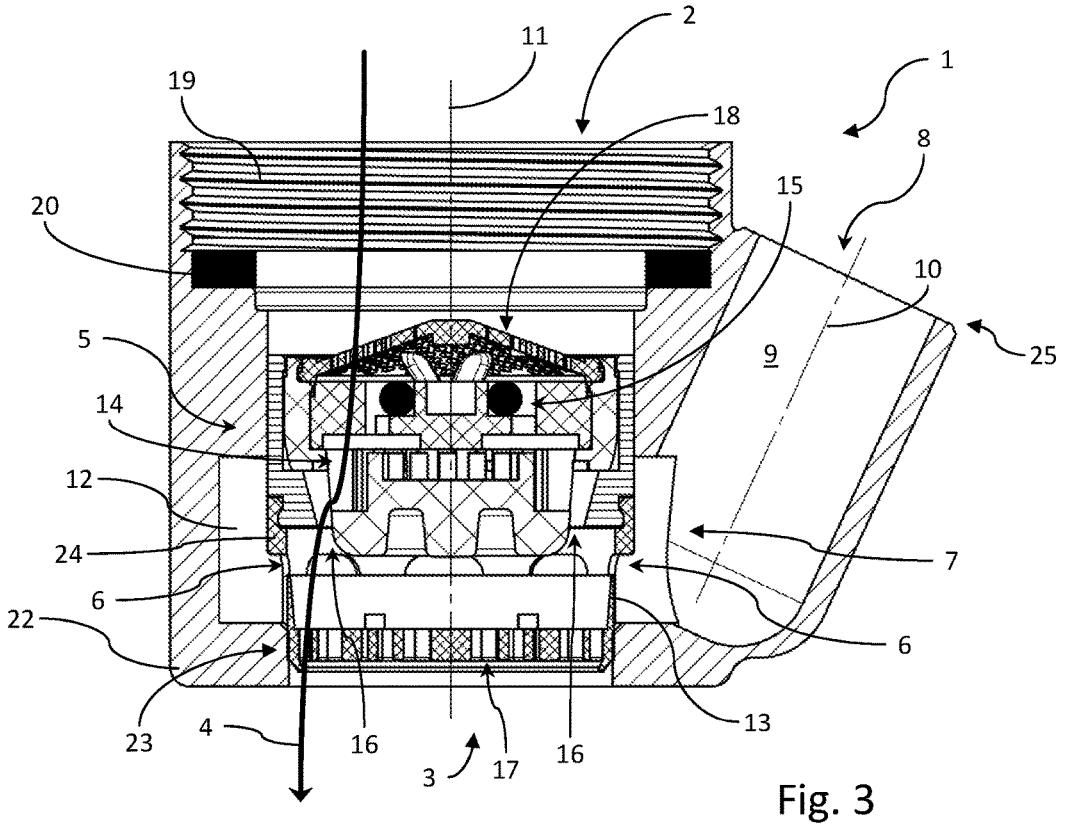
FIG. 3 shows the sanitary outflow part according to the invention from FIG. 1 in a longitudinal section.
Figure 1:
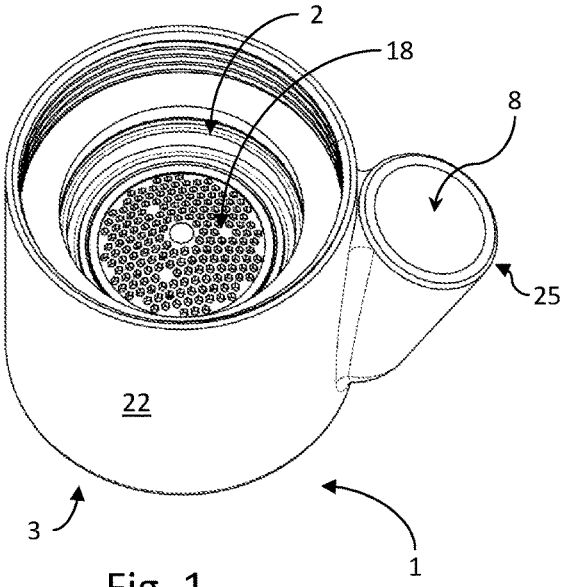
FIG. 1 shows a sanitary outflow part according to the invention in an oblique view from above.
Figure 2:
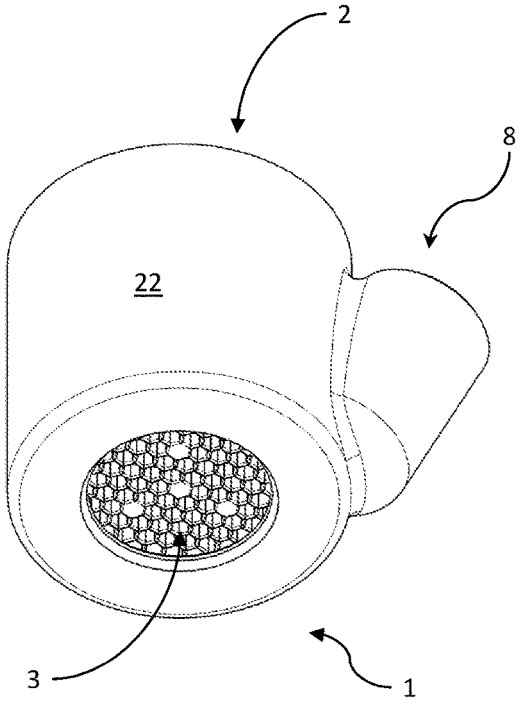
FIG. 2 shows the sanitary outflow part according to the invention from FIG. 1 in an oblique view from below.

FIGS. 1 to 4 show different views of a sanitary outflow part which is denoted as a whole by 1. The sanitary outflow part 1 has an inlet opening 2 and an outlet opening 3.

The inlet opening 2 is designed in a manner known per se for fastening to a fitting outflow of a fitting.

A flow path 4 for water runs in the sanitary outflow part 1 between the inlet opening 2 and the outlet opening 3.

Likewise arranged in a manner known per se in the flow path 4 is a jet regulator unit 5 which is flowed through by the liquid in the flow path 4.

The jet regulator unit 5 has at least one aeration opening 6, in this case even a multiplicity of aeration openings 6. Air enters from the outside through the at least one aeration opening 6 in order to mix with the water in the flow path 4 to form an aerated jet.

On the sanitary outflow part 1 there is formed a secondary outlet 7 through which water can emerge from the flow path 4 to the outside without flowing through the outlet opening 3.

For this purpose, the secondary outlet 7 is branched off from the flow path 4 between the jet regulator unit 5 and the outlet opening 3.

The secondary outlet 7 is led out to a secondary outlet opening 8 which is formed so as to be laterally spaced apart from the flow path 4 and separate from the outlet opening 3.

From the sectional illustration in FIG. 3, it can be seen that the secondary outlet opening 8 is arranged above the jet regulator unit 5 in a usage position.

The secondary outlet 7 forms a duct 9 which extends to the secondary outlet opening 8. The secondary outlet opening 8 is thus formed at the open end 25 of the duct 9.

This duct 9 has a duct axis 10 which extends at an angle with respect to the flow path 4 and thus with respect to the longitudinal axis 11. Here, the profile direction of the duct 9 is oriented obliquely upward and thus counter to the flow direction of the flow path 4, which is directed substantially downward.

The flow path 4 is formed without a valve at least downstream of the jet regulator unit 5.

During normal use, the water flows along the flow path 4 without water emerging from the secondary outlet opening 8.

Between the jet regulator unit 5 and the outlet opening 3 there is formed an aeration chamber 12 which is connected to the secondary outlet 7.

The aeration chamber 12 is of ring-shaped form and surrounds the aeration openings 6 such that air can enter through the secondary outlet 7 in order to flow to the aeration openings 6.

It is thus achieved that the aeration openings 6 can be fed with air from the surroundings via the aeration chamber 12 and the secondary outlet openings 8. To this end, the aeration chamber 12 may be sealed downstream of the secondary outlet 7 through tight contact between the housing 22 and cartridge housing 24. Thus, air sucked in by the process of aeration within the cartridge 21 through the aeration opening 6 is sucked in through the secondary outlet 7. This air dries up the secondary outlet 7 when not in use.

Here, the aeration chamber 12 extends outside the normal flow path 4 such that, during normal operation, no water or substantially no water enters the aeration chamber 12.

The secondary outlet 7 is branched off from the aeration chamber 12 downstream of the jet regulator unit 5, such that water emerging from the aeration openings 6—which water emerges in a manner yet to be described in more detail if the outlet opening 3 is closed off—emerges into the secondary outlet 7 and further from the secondary outlet opening 8.

The outlet opening 3 is coordinated with the jet regulator unit 5 such that an internal diameter of the outlet opening 3 is larger than a jet diameter of the jet emerging from the jet regulator unit 5. Thus, a normally emerging water jet does not wet the edge of the outlet opening 3.

During normal operation, the water in the flow path 4 draws air in through the aeration openings 6 owing to nozzle effects, which air is drawn in via the duct 9 and the secondary outlet 7. This constantly flowing air ensures that the duct 9 and the secondary outlet 7 are kept dry. This reduces or prevents microbiological infestation of the secondary outlet 7 and of the duct 9.

The aeration chamber 12 is separated from the flow path 4 by a closed wall 13, which is interrupted only by the aeration openings 6.

In this way, water is prevented from entering the secondary outlet 7 from the flow path 4 for as long as the outlet opening 3 is open.

The jet regulator unit 5 has a diffuser 14 such as is known per se, by which the aeration of the water jet in the flow path 4 is achieved or initiated.

Positioned upstream of the diffuser 14 is a flow rate regulator 15 which is likewise known per se and which is designed for setting a throughflow rate per unit of time which is independent of pressure within a working range.

The combination of flow rate regulator 15 and diffuser 14 ensures that a shaped, aerated jet with the desired jet pattern emerges at the outlet opening 3 in a manner practically independent of the pressure conditions at the inlet opening 2.

On the diffuser 14, at the outflow side, there are formed diffuser exit openings 16 which open out within the wall 13. At the downstream side in relation to the wall there is formed a straightener 17 which homogenizes the aerated jet in the flow path 4.

At the inflow side in relation to the flow rate regulator 15, or at least at an inflow side of the jet regulator unit 5, there is arranged an upstream screen 18.

For the fastening of the sanitary outflow part 1 to the inlet opening 2 on a fitting, a thread 19 is formed on the inlet opening 2, which thread can be screwed together with a corresponding counterpart thread on a fitting outflow.

Into the inlet opening 2 there is placed a sealing ring 20 by which the sanitary outflow part 1 can be sealed off with respect to the fitting.

Figure 4:
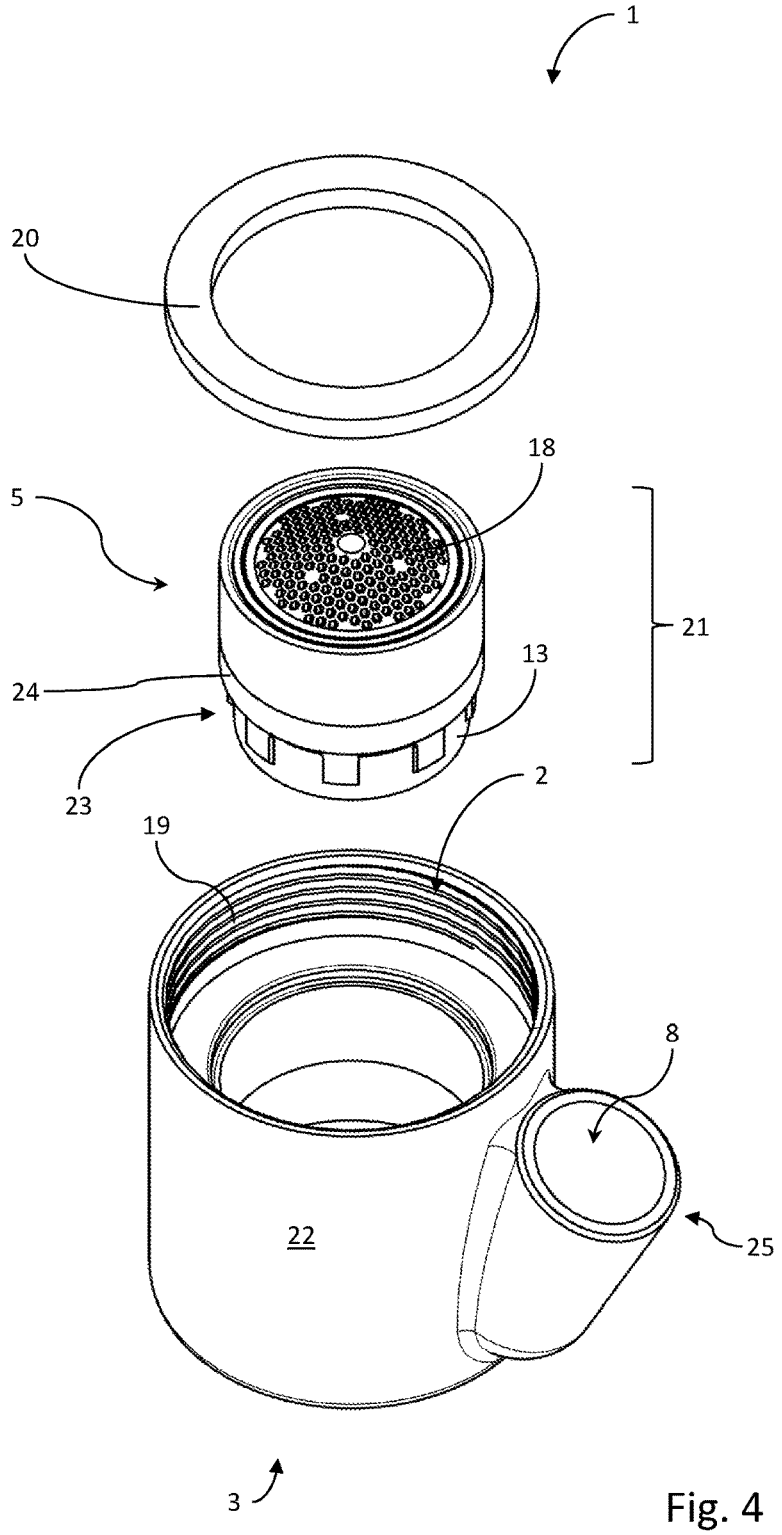
FIG. 4 shows the sanitary outflow part according to the invention from FIG. 1 in a partially exploded illustration.

In FIG. 4, it is clear that the jet regulator unit 5 is formed as part of a cartridge 21 which can be inserted via the inlet opening 2. For this purpose, the jet regulator unit 5 is supplemented by a cartridge housing 24, which also forms the wall 13. The cartridge housing 24 also bears the straightener 17.

The described branching of the secondary outlet 7 is thus arranged between the jet regulator unit 5 and the straightener 17.

The inlet opening 2, the outlet opening 3 and the secondary outlet opening 8 with the associated duct 9 are formed in a housing 22 which is manufactured from plastic or from metal and which is thus dimensionally stable.

The cartridge-like jet regulator unit 5 can be inserted through the inlet opening 2 into the outlet opening 3 such that the jet regulator unit 5 is, at least in its end region 23, seated in the outlet opening 3. Here, the outer diameter of the end region 23 is coordinated with the inner diameter of the outlet opening 3 such that the jet regulator unit 5 is held on the inlet opening 2 counter to the water pressure.

The outlet opening 3 is dimensioned such that it can be closed off using a finger, for example using an index finger of typical size.

If the outlet opening 3 is closed off, the water in the flow path 4 can no longer flow out through the outlet opening 3. The water seeks another way out, and passes through the aeration openings 6 into the secondary outlet 7 and from there out of the secondary outlet opening 8 via the duct 9.

The orientation of the duct axis 10 results in an obliquely upwardly directed jet which emerges in an arc which extends over a moderate distance such that drinking or mouth rinsing is made possible, but on the other hand the water jet does not overshoot a wash basin which is arranged below the fitting.

As soon as the outlet opening 3 is opened again, the water jet from the secondary outlet opening 8 peters out, and the drawn-in air for the aeration of the water in the flow path 4 leads to drying-out of the duct 9 and of the secondary outlet 7.

The sanitary outflow part 1 which is shown is, in a preferred use, screwed to a fitting outflow of a sanitary fitting of a wash basin and/or drinking basin.

In the case of the sanitary outflow part 1, it is thus provided according to the invention that, between an inlet opening 2 and an outlet opening 3, in a flow path 4 which leads through a jet regulator unit 5, a secondary outlet 7 branches off downstream of the jet regulator unit 5, which secondary outlet is led to an additional secondary outlet opening 8 such that water entering via the inlet opening 2 emerges to the secondary outlet opening 8 at least when the outlet opening 3 of the sanitary outflow part 1 is closed off.

LIST OF REFERENCE DESIGNATIONS

1 Sanitary outflow part
2 Inlet opening
3 Outlet opening
4 Flow path
5 Jet regulator unit
6 Aeration opening
7 Secondary outlet
8 Secondary outlet opening
9 Duct
10 Duct axis
11 Longitudinal axis
12 Aeration chamber
13 Wall
14 Diffuser
15 Flow rate regulator
16 Diffuser exit opening
17 Straightener
18 Upstream screen
19 Thread
20 Sealing ring

21 Cartridge
22 Housing
23 End region
24 Cartridge housing
25 Open end

The invention claimed is:

1. A sanitary outflow part (1), comprising:

a housing with an inlet opening (2), which is adapted to be fastened to a fitting, and an outlet opening (3), a jet regulator unit (5) with at least one aeration opening (6) arranged in a flow path (4) between the inlet opening (2) and the outlet opening (3), a secondary outlet (7) that branches off in the flow path (4) between the jet regulator unit (5) and the outlet opening (3) that leads out in a laterally spaced-apart manner to a separate secondary outlet opening (8) and an aeration chamber (12) formed between the inlet opening (2) and the outlet opening (3), said aeration chamber extends outside the flow path (4), and the at least one aeration opening (6) is connected to the aeration chamber (12), wherein the secondary outlet (7) is branched off from the aeration chamber (12).

2. The sanitary outflow part (1) as claimed in claim 1, wherein the secondary outlet opening (8) is formed above the jet regulator unit (5) in a usage position.

3. The sanitary outflow part (1) as claimed in claim 1, wherein the secondary outlet (7) forms a duct (9) which runs at an angle with respect to the flow path (4) and counter to a flow direction of the flow path (4), and the secondary outlet opening (8) is formed at an open end (25) of the duct (9).

4. The sanitary outflow part (1) as claimed in claim 1, wherein the flow path (4) is formed without a valve downstream of the jet regulator unit (5).

5. The sanitary outflow part (1) as claimed in claim 1, wherein the aeration chamber (12) is ring-shaped, and the at least one aeration opening (6) is capable of being fed with air from the aeration chamber (12) during use.

6. The sanitary outflow part (1) as claimed in claim 1, wherein the aeration chamber (12) is separated from the flow path (4) by a closed wall (13) in which the at least one aeration opening (6) is formed.

7. The sanitary outflow part (1) as claimed in claim 6, wherein at least one diffuser exit opening (16) is arranged radially within the closed wall (13).

8. The sanitary outflow part (1) as claimed in claim 1, wherein an internal diameter of the outlet opening (3) is coordinated with a jet diameter predefined by the jet regulator unit (5).

9. The sanitary outflow part (1) as claimed in claim 1, wherein the jet regulator unit (5) includes at least one of a diffuser (14) or a flow rate regulator (15).

10. The sanitary outflow part (1) as claimed in claim 1, wherein, on the inlet opening (2), there is formed a thread (19) which is adapted to be screwed together with a counterpart thread of a fitting.

11. The sanitary outflow part (1) as claimed in claim 1, further comprising a sealing ring (20) placed into the inlet opening (2).

12. The sanitary outflow part (1) as claimed in claim 1, wherein the jet regulator unit (5) is at least one of insertable or removable as a cartridge (21) via the inlet opening (2).

13. The sanitary outflow part (1) as claimed in claim 1, wherein the housing (22) which forms the inlet opening (2), the outlet opening (3), and the secondary outlet opening (8) is manufactured from a dimensionally stable material.

14. The sanitary outflow part (1) as claimed in claim 1, wherein the jet regulator unit (5) is inserted into the outlet opening (3).

15. The sanitary outflow part (1) as claimed in claim 1, wherein the outlet opening (3) is adapted to be closed off using a finger.

16. The sanitary outflow part (1) as claimed in claim 1, wherein the aeration chamber (12) is sealed downstream of the secondary outlet (7).

17. A method of providing an alternate water flow from a sanitary fitting, comprising providing the sanitary outflow part (1) as claimed in claim 1, attaching the sanitary outflow part (1) onto the sanitary fitting, and closing the outlet opening (3) such that the alternate water flow is discharged from the separate secondary outlet opening (8).

18. The method of claim 17, wherein the sanitary fitting is of a wash basin or drinking basin.

19. The method of claim 17, wherein the sanitary outflow part (1) is mounted by screw fastening on an outflow of the sanitary fitting.

20. The method of claim 17, wherein an air stream eventually sucked in through the at least one aeration opening (6) is used for drying the secondary outlet (7).

* * * * *